US011137238B2

(12) United States Patent
Main

(10) Patent No.: US 11,137,238 B2
(45) Date of Patent: Oct. 5, 2021

(54) MAGAZINE RETENTION ASSEMBLY AND ASSOCIATED ACCESSORIES

(71) Applicant: BLACKPOINT TACTICAL LLC, Alpharetta, GA (US)

(72) Inventor: Adam Main, Alpharetta, GA (US)

(73) Assignee: BLACKPOINT TACTICAL LLC, Alpharetta, GA (US)

( * ) Notice: Subject to any disclaimer, the term of this patent is extended or adjusted under 35 U.S.C. 154(b) by 0 days.

(21) Appl. No.: 16/998,344

(22) Filed: Aug. 20, 2020

(65) Prior Publication Data

US 2021/0072009 A1 Mar. 11, 2021

Related U.S. Application Data

(60) Provisional application No. 62/896,848, filed on Sep. 6, 2019.

(51) Int. Cl.
*F42B 39/02* (2006.01)

(52) U.S. Cl.
CPC ..... *F42B 39/02* (2013.01)

(58) Field of Classification Search
CPC ..... F42B 39/02; F42B 39/002; F42B 39/00; F42B 39/26; A45F 2200/0591; A45F 5/021; A45F 5/02; F41A 9/63
See application file for complete search history.

(56) References Cited

U.S. PATENT DOCUMENTS

| | | | | |
|---|---|---|---|---|
| 4,799,323 | A * | 1/1989 | Musgrave | F41A 17/38 42/90 |
| 9,668,568 | B2 * | 6/2017 | Evans | A45F 5/00 |
| 10,809,029 | B1 * | 10/2020 | Lerner | F42B 39/02 |
| 10,842,253 | B2 * | 11/2020 | Main | A45F 5/021 |
| 2007/0278269 | A1 * | 12/2007 | Rogers | F41A 9/65 224/239 |
| 2010/0176173 | A1 * | 7/2010 | Felts | F42B 39/02 224/665 |
| 2013/0248566 | A1 * | 9/2013 | Solomon | F42B 39/02 224/191 |
| 2014/0075650 | A1 * | 3/2014 | Garrison | F41C 33/02 2/300 |
| 2019/0014892 | A1 * | 1/2019 | Bryant | A45F 5/021 |

* cited by examiner

*Primary Examiner* — Corey N Skurdal
(74) *Attorney, Agent, or Firm* — Eversheds Sutherland (US) LLP

(57) ABSTRACT

A magazine holster assembly comprising a magazine holster, an outer housing coupled to the magazine holster, and a magazine contactor assembly disposed within the outer housing. The magazine contactor assembly comprising an isolator, a contactor secured within the isolator, and a contactor fastener threaded through the isolator to the contactor.

17 Claims, 16 Drawing Sheets

MAGAZINE RETENTION ASSEMBLY AND ASSOCIATED ACCESSORIES

CROSS-REFERENCE TO RELATED APPLICATIONS

The disclosure claims priority to and the benefit of U.S. provisional patent application No. 62/896,848, filed Sep. 6, 2019, which is hereby incorporated by reference herein in its entirety.

FIELD

The disclosure generally relates to magazines and more particularly relates to a magazine holster and a magazine retention assembly.

BACKGROUND

Magazine holsters (also known as magazine sheaths) are generally designed to carry a magazine on or around a garment. Magazine holsters typically hook onto jackets, belts, pants, or some other garment and allow a user to carry a magazine with additional ammunition. Having a magazine holster with a spare magazine filled with ammunition may be beneficial in many situations. Therefore, a magazine holster should be capable of snuggly storing a magazine through any situation and be easily accessible to the carrier.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION OF EXAMPLE EMBODIMENTS

Overview

A magazine holster assembly is described herein. The magazine holster assembly can include a magazine holster and a magazine contactor assembly. The magazine contactor assembly can be secured to the magazine holster. The magazine holster can receive a magazine therein, and the magazine contactor assembly is configured to adjustably abut the magazine within the magazine holster. For example, the magazine contactor assembly can adjust the amount of force applied to the magazine stored within the magazine holster. One benefit to the adjustable magazine contactor assembly is the ability to customize the amount of force applied to the magazine stored within the magazine holster. For example, adding more force from the magazine contactor assembly to the magazine in the magazine holster can prevent the magazine from slipping out from the holster. Similarly, decreasing the amount of force from the magazine contactor assembly can permit faster removal of the magazine from the magazine holster.

Illustrative Embodiments

Example embodiments of the disclosure now will be described more fully hereinafter with reference to the accompanying drawings, in which exemplary embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like, but not necessarily the same or identical, elements throughout.

Figure 1A:
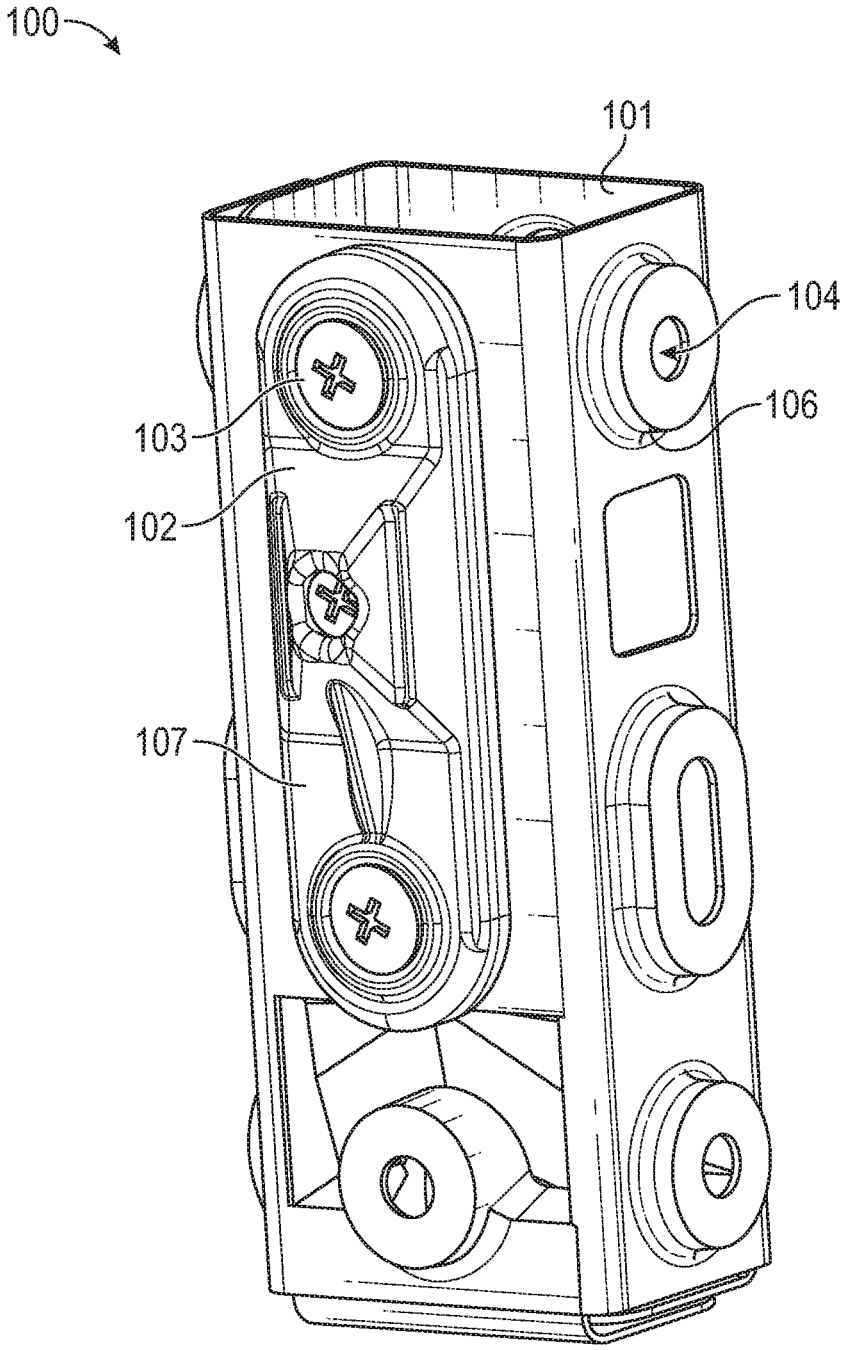
FIG. 1A depicts a perspective elevation view of a magazine holster assembly in accordance with one or more embodiments of the disclosure.
Figure 1B:
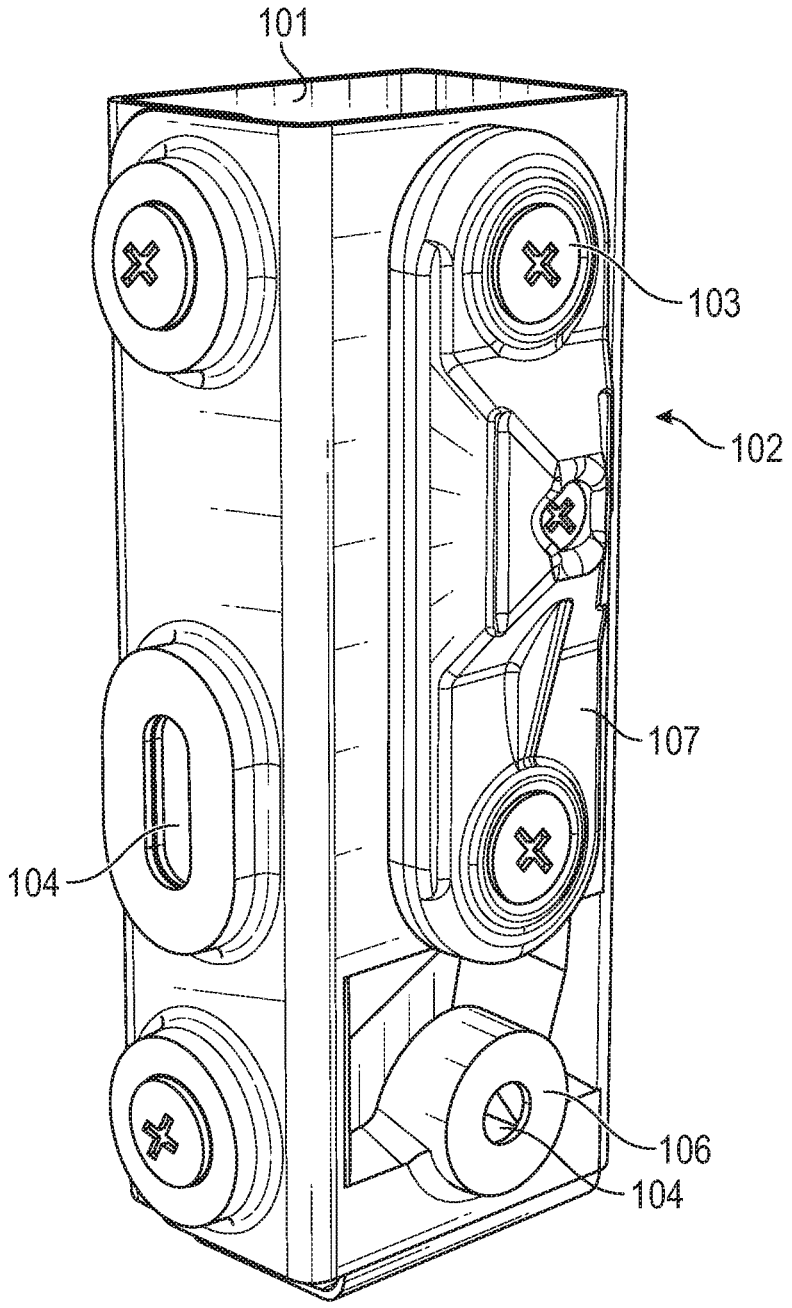
FIG. 1B depicts a perspective elevation view of the magazine holster assembly in accordance with one or more embodiments of the disclosure.
Figure 1C:
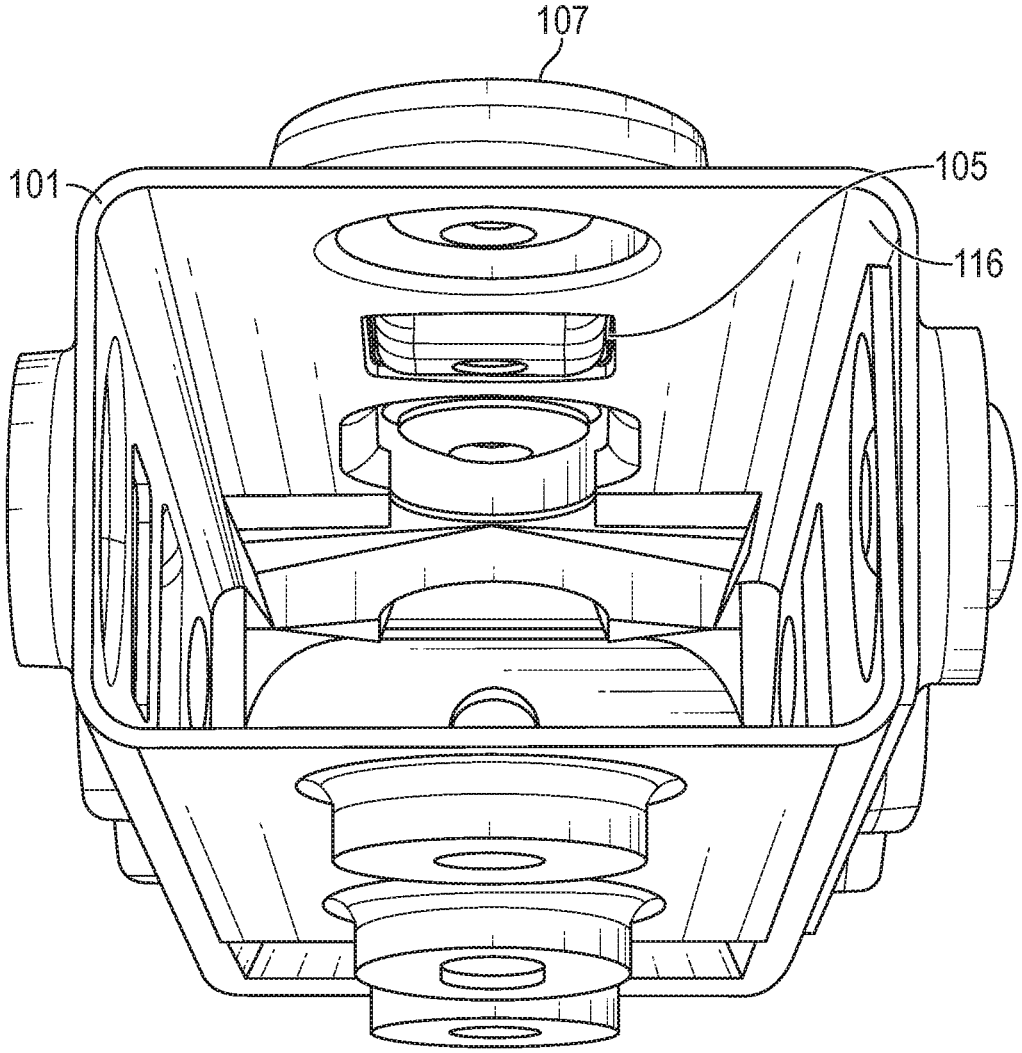
FIG. 1C depicts a top perspective view of the magazine holster assembly in accordance with one or more embodiments of the disclosure.

FIGS. 1A-1C depicts various views of a magazine holster assembly 100 in accordance with one or more embodiments of the disclosure. The magazine holster assembly 100 can include a magazine holster 101 and a magazine contactor assembly 102. The magazine contactor assembly 102 can be mounted onto a magazine holster 101 via a set of fasteners 103 (e.g., screws or the like) that are secured through the magazine contactor assembly 102 to one or more relief holes 104 on the magazine holster 101. The relief holes 104 can be disposed on a raised surface 106 of the magazine holster 101. The relief holes 104 may be any suitable size, shape, or configuration. In some examples, the magazine contactor assembly 102 is configured to be aligned with a plurality of relief holes 104 disposed about the magazine holster 101. The plurality of relief holes 104 can be elliptical, round, or rectangular. The set of fasteners 103 can be mounted into the round and/or elliptical relief holes. As shown in FIG. 1C, the rectangular relief hole can receive a contactor 105 therethrough, and the contactor 105 can extend into an inner volume 116 of the magazine holster 101. In other examples, the relief holes 104 can be other shapes and receive components described herein. The raised surface 106 and the relief holes 104 can receive an outer housing 107 of the magazine contactor assembly 102.

Figure 1D:
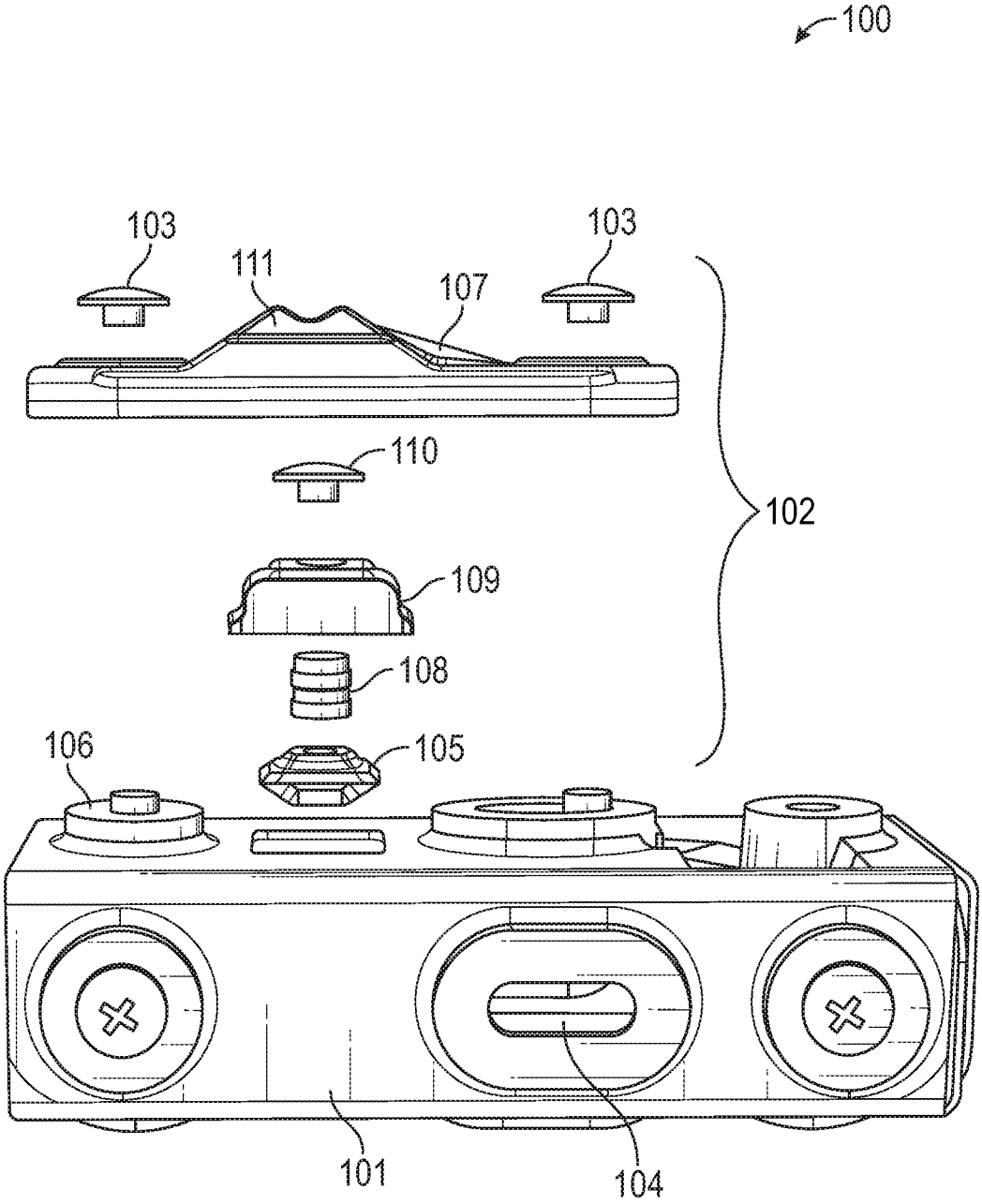
FIG. 1D depicts an exploded view of the magazine holster assembly in accordance with one or more embodiments of the disclosure.
Figure 2:
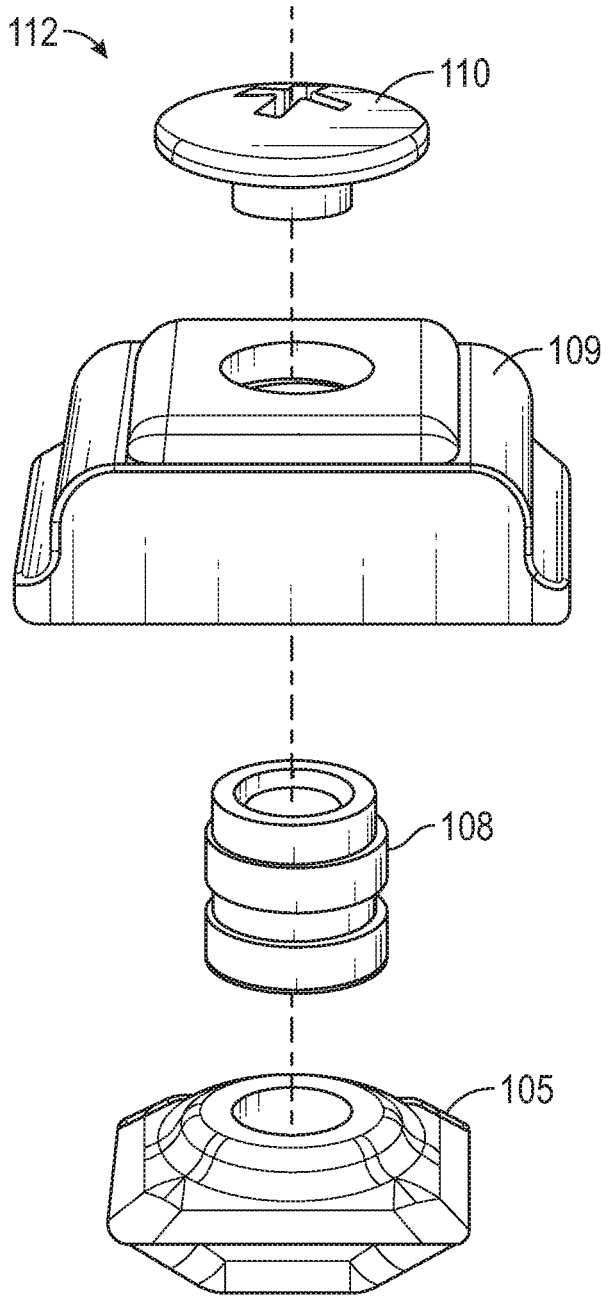
FIG. 2 depicts an exploded view of a contactor assembly of the magazine holster assembly in accordance with one or more embodiments of the disclosure.
Figure 7A:
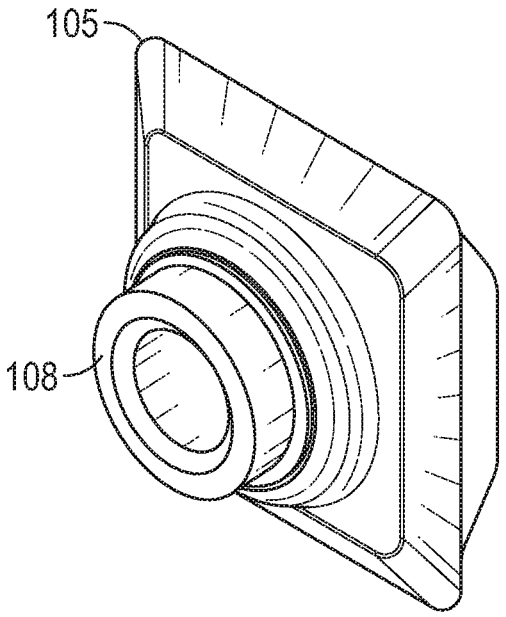
FIG. 7A depicts a rear perspective elevation view of the contactor and a contactor fastener receiver of the magazine holster assembly in accordance with one or more embodiments of the disclosure.
Figure 7B:
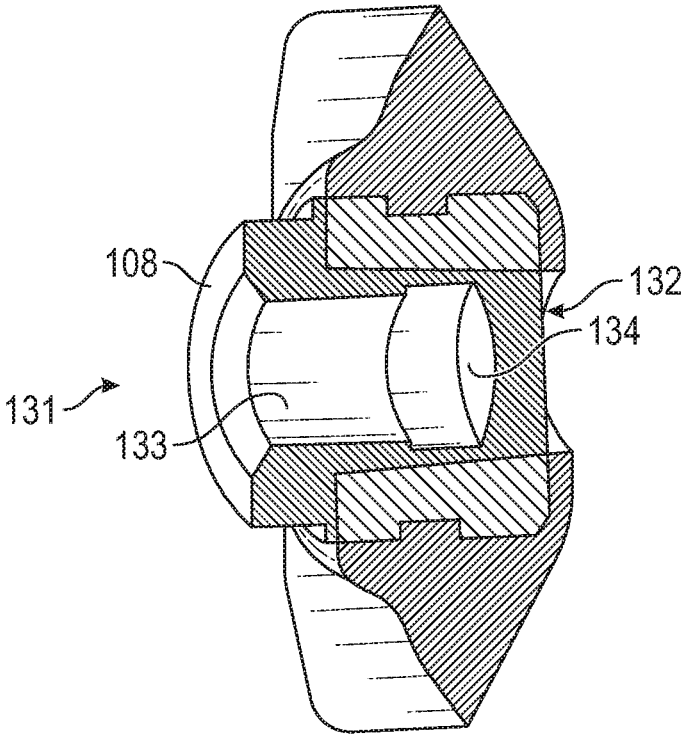
FIG. 7B depicts a cross-sectional elevation view of the contactor and the contactor fastener receiver of the magazine holster assembly in accordance with one or more embodiments of the disclosure.
Figure 8A:
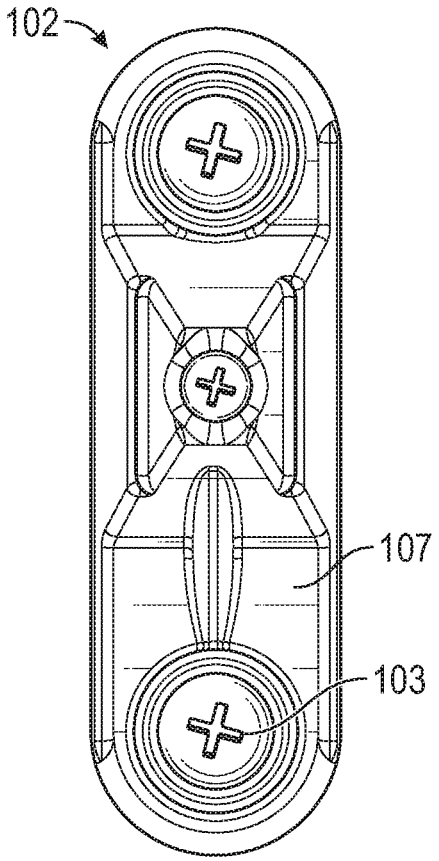
FIG. 8A depicts a front elevation view of the magazine contactor assembly in accordance with one or more embodiments of the disclosure.
Figure 8B:
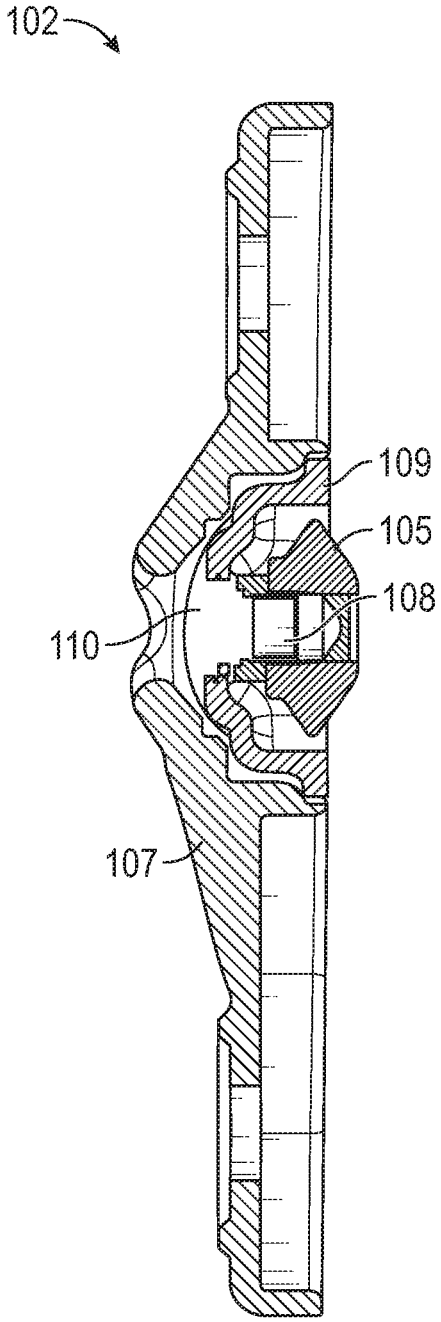
FIG. 8B depicts a side cross-sectional view of the magazine contactor assembly in accordance with one or more embodiments of the disclosure.

FIG. 1D depicts an exploded view of the magazine holster assembly 100 in accordance with one or more embodiments of the disclosure. The magazine contactor assembly 102 of the magazine holster assembly 100 can include the contactor 105, a contactor fastener receiver 108, an isolator 109, and a contactor fastener 110 (herein, together referred to as a contactor assembly 112 as shown in FIG. 2). In some examples, the outer housing 107 includes a raised (or thicker) portion 111 that includes the contactor assembly 112 substantially therein. In some instances, the raised portion 111 provides a housing about the contactor assembly. For example, the contactor fastener 110 can extend through the isolator 109 from a first isolator side 113 to a second isolate side 114 (e.g., partially depicted in FIG. 2). The contactor fastener 110 can enter a first end 115 of the contactor fastener receiver 108 to hold the contactor 105 within the isolator 109. The contactor fastener receiver 108 can be embedded within the contactor 105, as depicted in FIGS. 7A and 7B. The contactor fastener 110 can rotate to extend or retract the contactor 105 through one of the relief holes 104. Beneficially, the contactor 105 can extend through one of the relief holes 104 to add additional force to a magazine stored within the magazine holster 101. Similarly, the contactor 105 can be retracted from within the inner volume of the magazine holster to remove any additional force to the magazine.

Figure 3A:
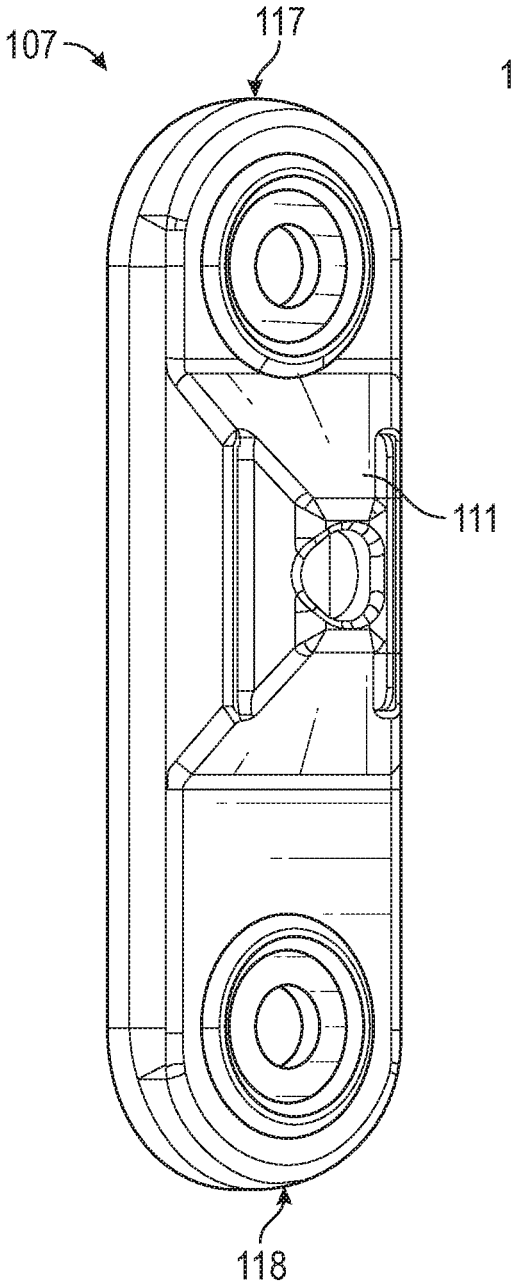
FIG. 3A depicts a front perspective elevation view of an outer housing of the magazine holster assembly in accordance with one or more embodiments of the disclosure.
Figure 3B:
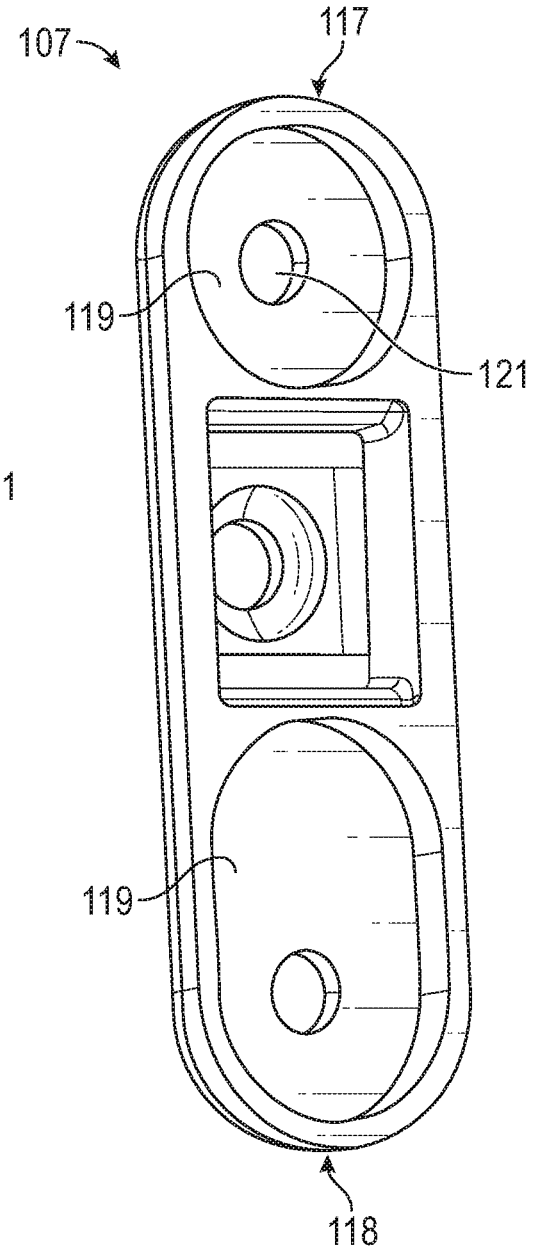
FIG. 3B depicts a rear perspective elevation view of the outer housing of the magazine holster assembly in accordance with one or more embodiments of the disclosure.

FIGS. 3A and 3B depict a front and a rear view of the outer housing 107 of the magazine holster assembly 100 in accordance with one or more embodiments of the disclosure. The outer housing 107 can include a first housing end 117 and a second housing end 118. Adjacent to each housing end 117/118, an inner side of the outer housing 107 can include a recessed surface 119. The recessed surface 119 are configured to receive the raised surface 106 of the magazine holster 101. In this manner, the recessed surface 119 can be aligned with the relief holes 104 on the magazine holster 101, and the set of fasteners 103 (e.g., as shown in FIG. 1A) can extend from a first surface 120 (e.g., an outer surface) of the outer housing, through a set of apertures 121, into the magazine holster 101. In some examples, the raised portion 111 on the outer side of the outer housing 107 may be disposed between the recessed surfaces 119 on the inner side of the outer housing 107. The raised portion 111 of the outer housing 107 is at least partially hollow and complements the shape of the isolator 109.

Figure 4A:
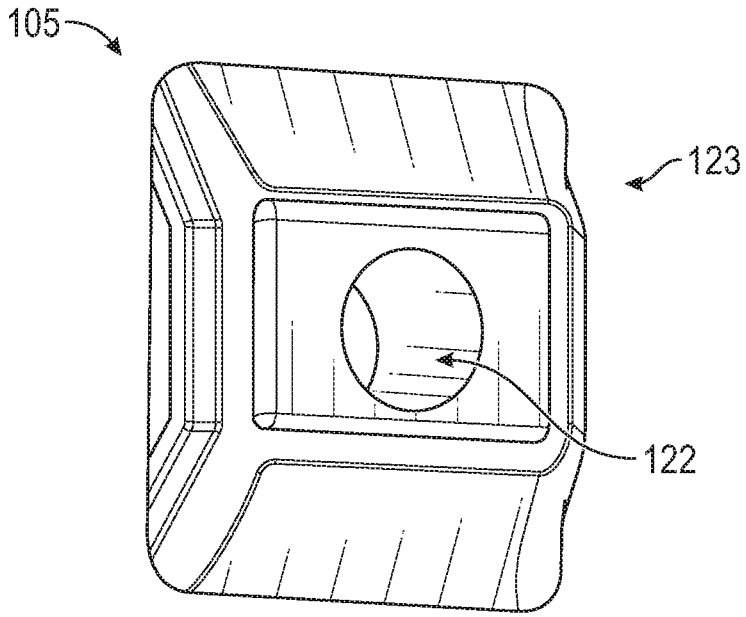
FIG. 4A depicts a front perspective elevation view of a contactor of the magazine holster assembly in accordance with one or more embodiments of the disclosure.
Figure 4B:
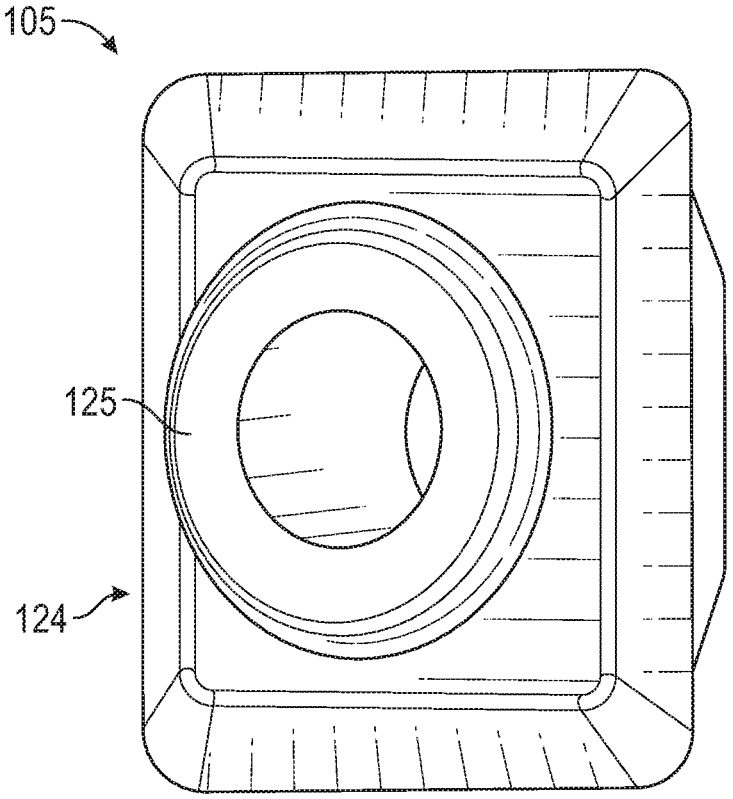
FIG. 4B depicts a rear perspective elevation view of the contactor of the magazine holster assembly in accordance with one or more embodiments of the disclosure.

FIGS. 4A and 4B depict a front and rear view of the contactor 105 in accordance with one or more embodiments of the disclosure. The contactor 105 can include a contactor aperture 122 extending through a first contactor side 123 to a second contactor side 124. In some examples, the contactor 105 includes a tapered surface on the first contactor side 123. As shown in FIG. 4B, the contactor 105 includes a ringed surface 125 on the second contactor side 124. The second contactor side 124 may be configured to contact a magazine within the magazine holster when the contactor fastener 110 is rotate to extend or retract the contactor 105 against the magazine.

Figure 5A:
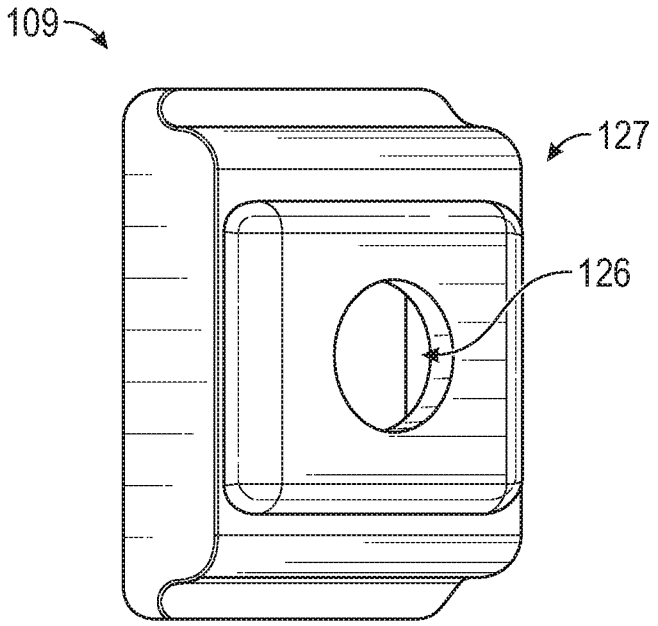
FIG. 5A depicts a front perspective elevation view of an isolator of the magazine holster assembly in accordance with one or more embodiments of the disclosure.
Figure 5B:
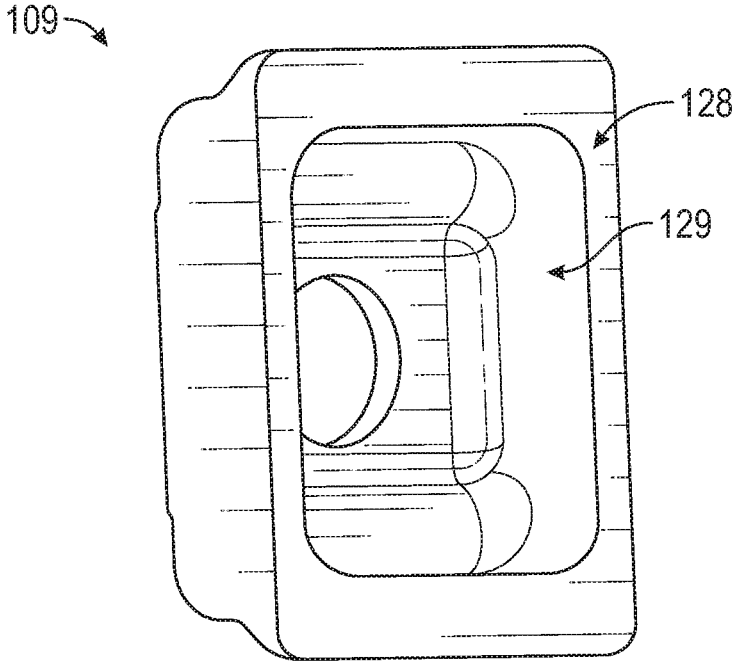
FIG. 5B depicts a rear perspective elevation view of the isolator of the magazine holster assembly in accordance with one or more embodiments of the disclosure.
Figure 6:
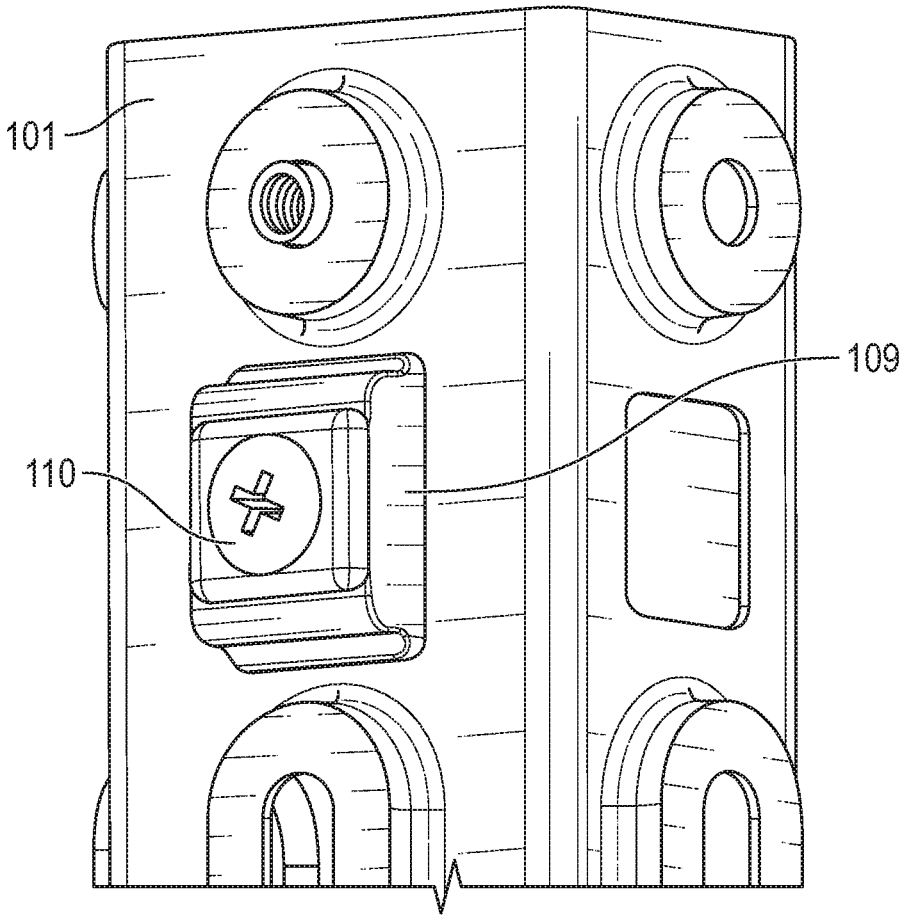
FIG. 6 depicts a front perspective elevation view of the isolator, a fastener, and a magazine sheath of the magazine holster assembly in accordance with one or more embodiments of the disclosure.

FIGS. 5A and 5B depict a front and rear view of the isolator 109 in accordance with one or more embodiments of the disclosure. The isolator 109 can include an isolator aperture 126 extending through a first isolator side 127 to a second isolator side 128. As shown in FIG. 5B, the isolator 109 includes isolator void 129 that can at least partially (or fully) receive the contactor 105. The contactor 105 can expand and contract from within the isolator void 129. In some examples, the second isolator side 128 abuts the magazine holster 101 and is flush with an inner side of the outer housing 107. The isolator 109 is configured to receive the contactor fastener 110 (e.g., as shown in FIG. 6) from first isolator side 127 to the second isolator side 128.

FIGS. 7A and 7B depict various views of the contactor 105 and contactor fastener receiver 108 in accordance with one or more embodiments of the disclosure. In some examples, the contactor fastener receiver 108 is secured within the contactor 105. The contactor fastener receiver 108 may be any suitable size, shape, or configuration. The contactor fastener receiver 108 can include a proximate end 131 and a distal end 132. The proximate end 131 can extend out from the contactor 105. The contactor fastener receiver 108 can include an inner surface 133 to receive the contactor fastener 110. In some examples, the inner surface 133 can be threaded to allow rotation of the contactor fastener 110. Adjacent to the distal end 132, the contactor fastener receiver 108 can include an arcuate surface 134. When the contactor fastener 110 rotates to the arcuate surface 134, the contactor 105 is recessed within the inner void 129 of the isolator 109.

Figure 9A:
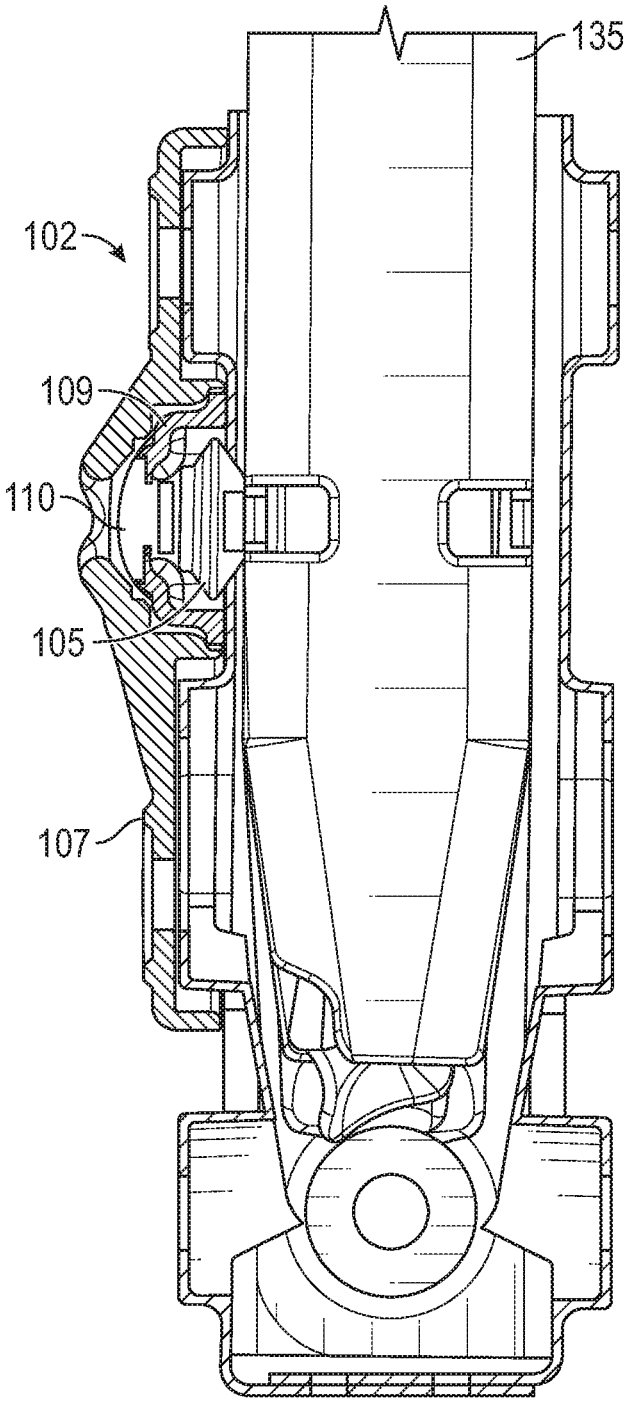
FIG. 9A depicts a cross-sectional elevation view of the magazine holster assembly and a magazine in accordance with one or more embodiments of the disclosure.
Figure 9B:
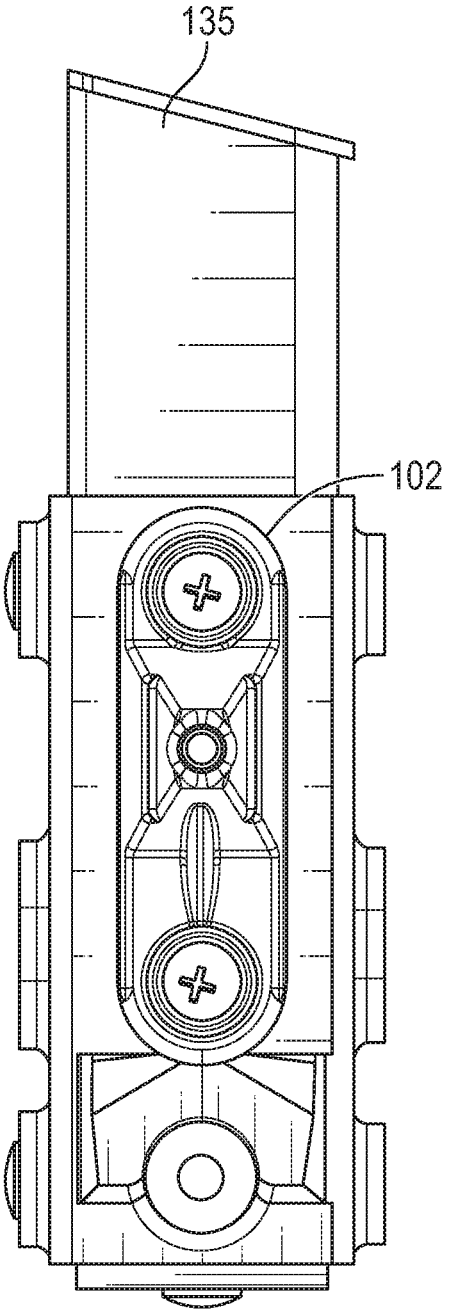
FIG. 9B depicts a front elevation view of the magazine holster assembly and the magazine in accordance with one or more embodiments of the disclosure.

FIGS. 8A-9B depict various views of the magazine holster assembly 100 in accordance with one or more embodiments of the disclosure. As shown in FIGS. 9A-9B, the magazine holster assembly 100 receives and contacts a firearm magazine 135. The magazine contactor assembly 102 of the magazine holster assembly 100 can include the contactor 105, the contactor fastener receiver 108, the isolator 109, and the contactor fastener 110. In some examples, the outer housing 107 includes the raised portion 111 that at least partially surrounds, protects, and houses the contactor assembly 112. The raised portion 111 may include a hole for accessing the contactor assembly 112. For example the contactor fastener 110 may be accessed via the hole in the raised portion 111. The contactor fastener 110 can enter the first end 115 of the contactor fastener receiver 108 to hold the contactor 105 within the isolator 109. The contactor fastener receiver 108 can be embedded within the contactor 105. The contactor fastener 110 can rotate to extend or retract the contactor 105 through one of the relief holes 104. Beneficially, the contactor 105 extending through one of the relief holes 104 can add additional force to the magazine 135 stored within the magazine holster 101. Similarly, the contactor 105 can retract from within the inner volume of the magazine holster to remove any additional force to the magazine 135.

Figure 10:
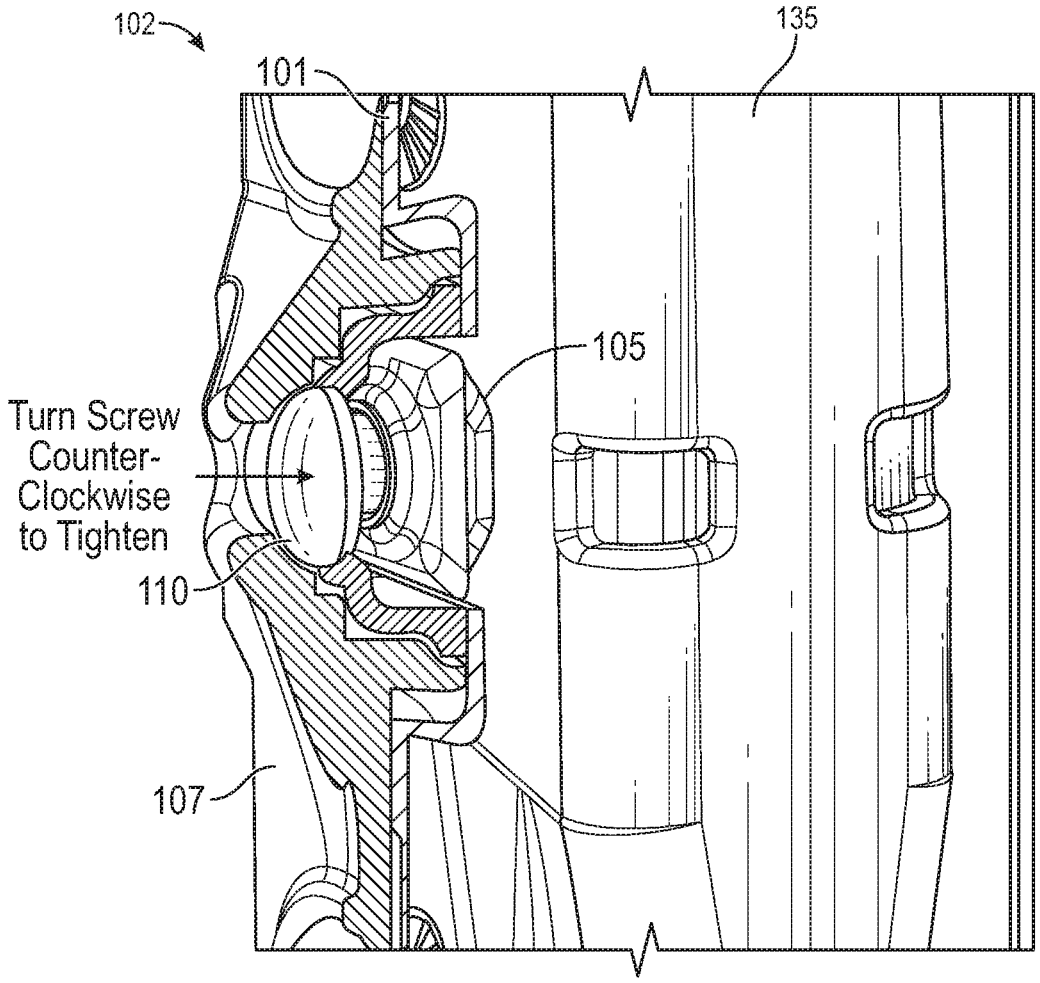
FIG. 10 depicts a cross-sectional view of the magazine holster assembly and the magazine in accordance with one or more embodiments of the disclosure.
Figure 11:
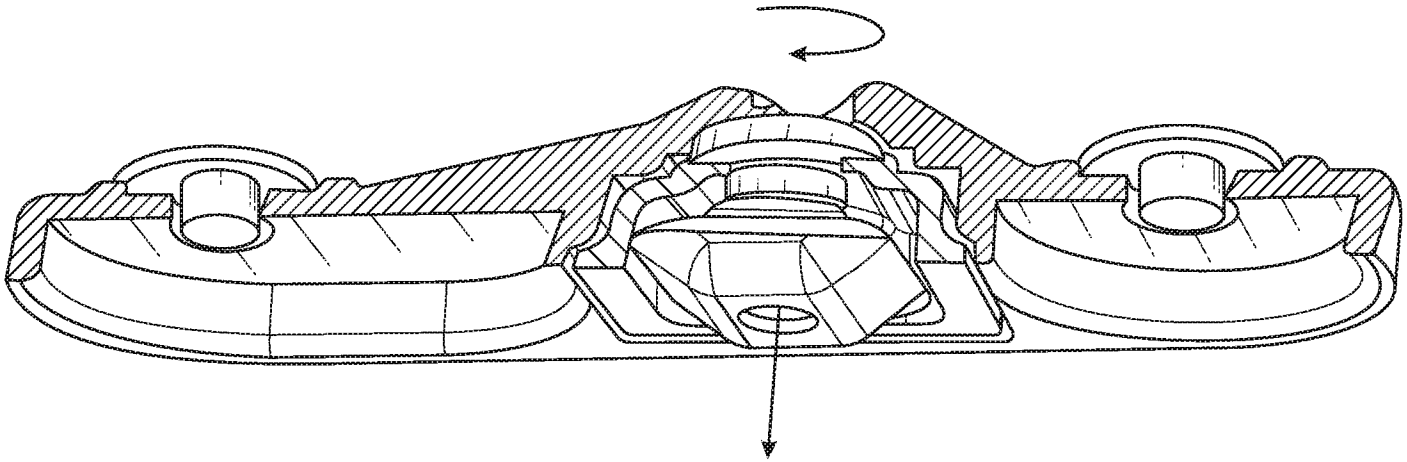
FIG. 11 depicts a rear perspective cross-sectional view showing the relative motion of a contactor fastener and contactor in accordance with one or more embodiments of the disclosure.
Figure 12:
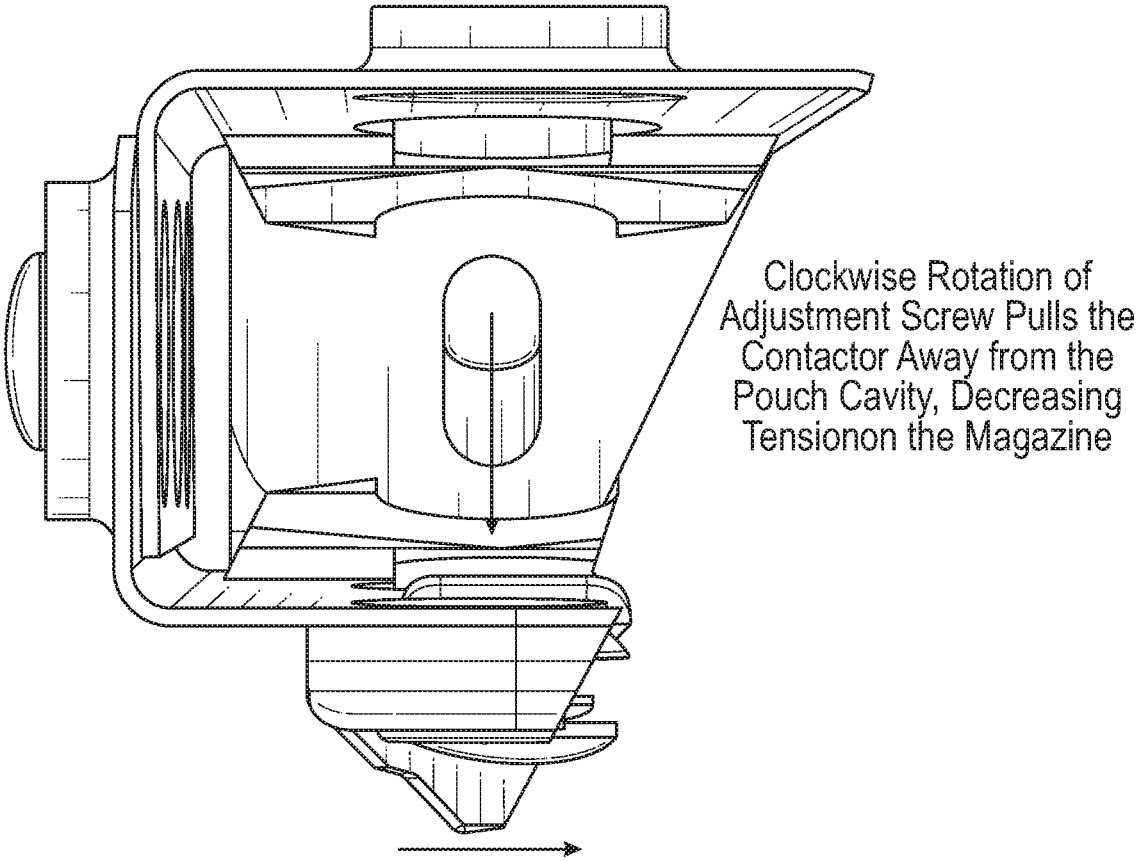
FIG. 12 depicts a top partial cross-sectional view showing the relative motion of a contactor fastener and contactor in accordance with one or more embodiments of the disclosure.

FIG. 10 depicts a cross-sectional view where the magazine holster assembly 100 abuts a firearm magazine 135 in accordance with one or more embodiments of the disclosure. In some examples, the contactor fastener 110 can rotate in a clockwise or counter-clockwise direction to push the contactor 105 towards or away from the firearm magazine 135, as further depicted in FIGS. 10-12.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A magazine holster assembly, comprising:
a magazine holster;
an outer housing coupled to the magazine holster; and
a magazine contactor assembly disposed within the outer housing and comprising
an isolator,
a contactor secured within the isolator, and
a contactor fastener threaded through the isolator to the contactor.

2. The magazine holster assembly of claim 1, wherein rotation of the contactor fastener is configured to extend or retract the contactor within the magazine holster.

3. The magazine holster assembly of claim 2, wherein the outer housing comprises a raised portion which is at least partially hollow and houses at least a portion of the magazine contactor assembly therein.

4. The magazine holster assembly of claim 3, wherein raised portion comprises a hole for accessing the contactor fastener.

5. The magazine holster assembly of claim 2, wherein the outer housing comprises a recessed surface configured to receive a raised surface of the magazine holster.

6. The magazine holster assembly of claim 1, wherein the magazine contactor assembly at least partially extends through a hole in the magazine holster.

7. The magazine holster assembly of claim 1, wherein the magazine contactor assembly comprises a contactor fastener receiver disposed within the contactor.

8. The magazine holster assembly of claim 7, wherein the contactor is attached to the contactor fastener via the contactor fastener receiver.

9. A magazine holster assembly for a magazine, the magazine holster assembly comprising:
a magazine holster;
a magazine contactor assembly disposed about the magazine holster and comprising
an isolator,
a contactor secured within the isolator, and
a contactor fastener threaded through the isolator to the contactor, wherein rotation of the contactor fastener is configured to extend the contactor within the magazine holster to secure the magazine therein.

10. The magazine holster assembly of claim 9, further comprising an outer housing coupled to the magazine holster.

11. The magazine holster assembly of claim 10, wherein the magazine contactor assembly is disposed at least partially within a void in the outer housing.

12. The magazine holster assembly of claim 11, wherein the outer housing comprises a hole for accessing the contactor fastener of the magazine contactor assembly.

13. The magazine holster assembly of claim 10, wherein the outer housing comprises a raised portion which is at least partially hollow and houses at least a portion of the magazine contactor assembly therein.

14. The magazine holster assembly of claim 10, wherein the outer housing comprises a recessed surface configured to receive a raised surface of the magazine holster.

15. The magazine holster assembly of claim 9, wherein the magazine contactor assembly at least partially extends through a hole in the magazine holster.

16. The magazine holster assembly of claim 9, wherein the magazine contactor assembly comprises a contactor fastener receiver disposed within the contactor.

17. The magazine holster assembly of claim 16, wherein the contactor is attached to the contactor fastener via the contactor fastener receiver.

* * * * *